US006922869B2

(12) United States Patent
Bivens et al.

(10) Patent No.: US 6,922,869 B2
(45) Date of Patent: Aug. 2, 2005

(54) DAMPER APPARATUS

(75) Inventors: Steven L. Bivens, Kankakee, IL (US); Joseph J. Bella, Plainfield, IL (US); Jefferey S. Cascio, Tinley Park, IL (US)

(73) Assignee: Illinois Tool Works Inc., Glenview, IL (US)

( * ) Notice: Subject to any disclaimer, the term of this patent is extended or adjusted under 35 U.S.C. 154(b) by 80 days.

(21) Appl. No.: 10/310,386

(22) Filed: Dec. 5, 2002

(65) Prior Publication Data

US 2003/0140451 A1 Jul. 31, 2003

Related U.S. Application Data

(60) Provisional application No. 60/351,439, filed on Jan. 25, 2002.

(51) Int. Cl.[7] ..... E05F 3/20; E05C 17/64

(52) U.S. Cl. ..... 16/54; 16/50; 16/307; 16/342

(58) Field of Search ..... 16/49, 51, 54, 16/319, 337, 307, 342, 50, 339, 82, 340; 188/290

(56) References Cited

U.S. PATENT DOCUMENTS

| | | | | | |
|---|---|---|---|---|---|
| 4,485,522 | A | * | 12/1984 | Chen | 16/54 |
| 4,653,616 | A | * | 3/1987 | Mizusawa | 188/290 |
| 4,694,530 | A | * | 9/1987 | Foggini | 16/82 |
| 4,697,673 | A | | 10/1987 | Omata | 188/291 |
| 4,759,051 | A | * | 7/1988 | Han | 455/437 |
| 5,109,571 | A | * | 5/1992 | Ohshima et al. | 16/307 |
| 5,111,548 | A | * | 5/1992 | Ohshima | 16/51 |
| 5,142,738 | A | * | 9/1992 | Ojima | 16/306 |
| 5,211,269 | A | * | 5/1993 | Ohshima | 188/290 |
| 5,449,054 | A | * | 9/1995 | Wiese et al. | 188/296 |
| 5,566,423 | A | * | 10/1996 | Hassler et al. | 16/319 |
| 5,887,930 | A | | 3/1999 | Klein | 296/37.12 |
| 6,223,395 | B1 | | 5/2001 | Miho et al. | 16/429 |
| 6,256,839 | B1 | * | 7/2001 | Wu | 16/366 |
| 6,336,252 | B1 | * | 1/2002 | Bando | 16/307 |
| 6,634,061 | B1 | * | 10/2003 | Maynard | 16/342 |

FOREIGN PATENT DOCUMENTS

| | | | |
|---|---|---|---|
| DE | 3315913 | A1 * | 11/1984 |
| DE | 3343049 | A1 * | 6/1985 |
| DE | 295 18 172 | U1 | 1/1996 |
| DE | 297 21 962 | U1 | 2/1998 |
| EP | 1 067 308 | A2 | 1/2001 |
| JP | 01190887 | A * | 7/1989 |
| JP | 02292480 | | 12/1990 |
| JP | 2000158971 | | 6/2000 |

* cited by examiner

*Primary Examiner*—Chuck Y. Mah
*Assistant Examiner*—Michael J Kyle
(74) *Attorney, Agent, or Firm*—Mark W. Croll; Paul F. Donovan

(57) ABSTRACT

A damper apparatus is disclosed for damping movement between a first and a second element. The apparatus includes an elongate housing secured to the first element, the housing having a first and a second end. The housing defines a bore which extends between the ends of the housing. A rotor is connected to the second element, the rotor including a first and a second portion. The first portion of the rotor is rotatably disposed within the bore of the housing. A biasing device has a first and a second termination, the biasing device extending between the second portion of the rotor and the housing for rotationally biasing the rotor relative to the housing. A seal is disposed between the first and second portions of the rotor. The seal cooperates with the bore for sealing the bore relative to the second portion of the rotor such that in use of the apparatus, damping fluid sealed within the bore by the seal dampens rotational movement of the rotor relative to the bore when the rotor is rotationally biased. The arrangement is such that movement between the first and second elements is dampened.

19 Claims, 4 Drawing Sheets

DAMPER APPARATUS

CROSS-REFERENCE TO RELATED APPLICATION

This application claims benefit to U.S. provisional application Ser. No. 60/351,439 filed on Jan. 25, 2002.

FIELD OF THE INVENTION

The present invention relates generally to a damper apparatus. More particularly, the present invention relates to a damper apparatus for damping movement between a first and a second element.

BACKGROUND OF THE INVENTION

Typical damper assemblies include a damping media disposed within a cavity defined by a housing. A rotor with an O-ring extending around the rotor is pushed into the cavity so that dampened relative rotation between the housing and the rotor is achieved, However, according to the present invention, once the rotor is fully depressed into the cavity, an annular ring at the top of the rotor snaps into corresponding open slots at an open end of the housing. The snap feature of the present invention keeps the rotor securely snapped into the housing while at the same time allowing the rotor to rotate freely within the housing. When the rotor is snapped in place, an exterior torsion spring is placed over the exposed end of the rotor. One end of the spring is keyed into a corresponding anchor in the rotor and the other end of the spring is keyed into a rib defined by the housing. The spring is held in place on the rotor by a series of ramped ribs or projections molded in the exposed end of the rotor.

In operation of the damper assembly, the housing is slid into the pivot point of the lid to be damped. A keyway on one end of the housing is keyed into a corresponding slot inside the pivot point of the lid, thus integrally fixing the damper housing to the lid. The lid with damper in place is then placed into a stationary base. Flats on the exposed end of the rotor line up with mating flats in the stationary base. Pins are then pushed through the stationary base into both ends of the damper. As the damped lid is rotated downwards, the damper housing rotates with the lid while the rotor is held stationary by the base. As the lid is rotated downward, the torsion spring is loaded thus putting an upward moment on the lid. When the lid is released, the spring unwinds thus rotating the rotor through the damper media thereby creating a damped motion while forcing the lid open.

An alternative arrangement according to the present invention leaves one end of the spring unattached to the damper rotor to allow for preloading of the spring as it is assembled into the pivot point of the lid.

In prior arrangements, a separate spring has been used to open the lid whereas in the present invention, the spring is an integral part of the damper assembly.

Also, in known dampers, a cap is used to retain the rotor and O-ring relative to the housing. The present invention does not require a cap thus allowing the overall diameter of the damper assembly to be smaller and therefore fit into smaller packages.

Some prior dampers utilize an internal spring within the housing. However, such internal springs have limited rotational force capabilities. In the present invention, the spring is disposed externally which provides an increased rotational force when compared with internal spring arrangements.

The external spring according to the present invention permits preloading of the damper spring as the damper is being assembled into the mating assembly. However, the prior art internal springs cannot be preloaded before assembly.

The present invention relates to a hinge damper with an integral torsion spring. The damper includes a housing, a rotor disposed within the housing, an O-ring for retaining a damping media within the housing and a spring for urging rotation of the rotor relative to the housing.

Therefore, it is a feature of the present invention to provide a hinge damper with an integral torsion spring that overcomes the problems associated with the prior art arrangements.

Another feature of the present invention is the provision of a hinge damper with an integral torsion spring that is reliable in use and that is relatively low in cost.

SUMMARY OF THE INVENTION

A damper apparatus is disclosed for damping movement between a first and a second element. The apparatus includes an elongate housing that is secured to the first element. The housing has a first and a second end, the housing defining a bore that extends between the ends of the housing. A rotor is secured to the second element. The rotor includes a first and a second portion. The first portion of the rotor is rotatably disposed within the bore of the housing. A biasing device has a first and a second termination. The biasing device extends between the second portion of the rotor and the housing for rotationally biasing the rotor relative to the housing. A seal is disposed between the first and second portions of the rotor. The seal cooperates with the bore for sealing the bore relative to the second portion of the rotor such that in use of the apparatus, damping fluid sealed within the bore by the seal dampens rotational movement of the rotor relative to the bore when the rotor is rotationally biased. The arrangement is such that movement between the first and second elements is dampened.

According to another aspect of the present invention, a damper apparatus is provided for damping movement between a first and a second element. The apparatus includes an elongate housing which is secured to the first element, the housing having a first and a second end. The housing defines a bore which extends between the ends of the housing.

A rotor is connected to the second element, the rotor including a first and a second portion. The first portion of the rotor is rotatably disposed within the bore of the housing.

A biasing device has a first and a second termination, the biasing device extending between the second portion of the rotor and the housing for rotationally biasing the rotor relative to the housing.

A seal is disposed between the first and second portions of the rotor, the seal cooperating with the bore for sealing the bore relative to the second portion of the rotor. The arrangement is such that in use of the apparatus, damping fluid sealed within the bore by the seal dampens rotational movement of the rotor relative to the bore when the rotor is rotationally biased so that movement between the first and second elements is dampened.

Also, the second termination of the biasing device is adjustably secured to the rotor for adjusting biasing of the housing relative to the rotor.

Other features and advantages of the invention will become apparent to those skilled in the art upon review of the following detailed description, claims and drawings in which like numerals are used to designate like features.

Figure 1:
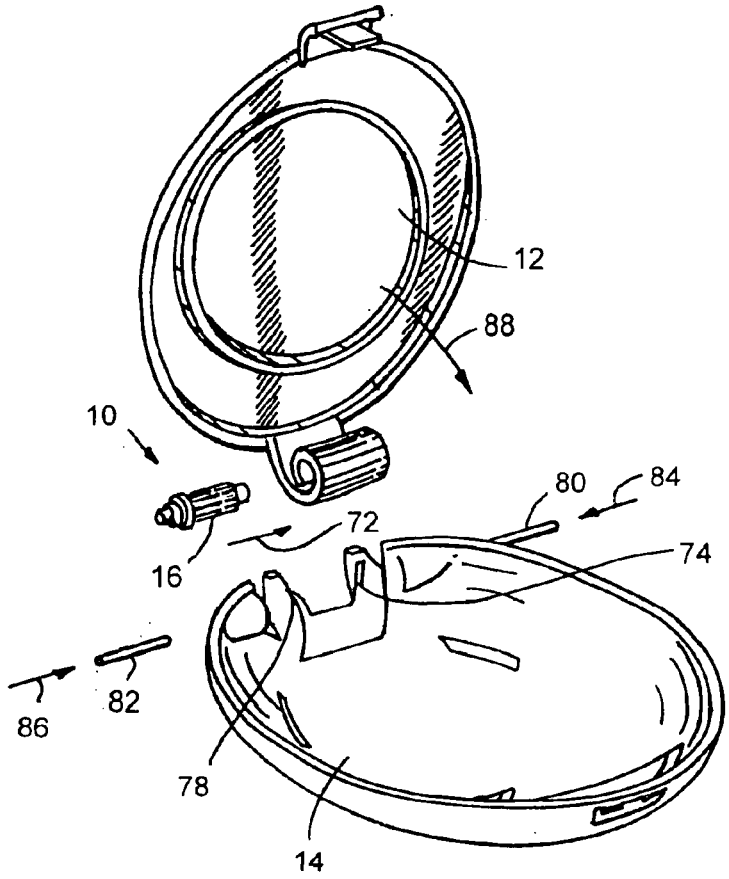
FIG. 1 is a perspective view of a damper apparatus according to the present invention for damping movement between a first and a second element.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

FIG. 1 is a perspective view of a damper apparatus generally designated 10 according to the present invention for damping movement between a first and a second element 12 and 14 respectively. As shown in FIG. 1, the apparatus 10 includes an elongate housing 16 that is, in the preferred embodiment, arranged to be secured to the first element 12.

Figure 2:
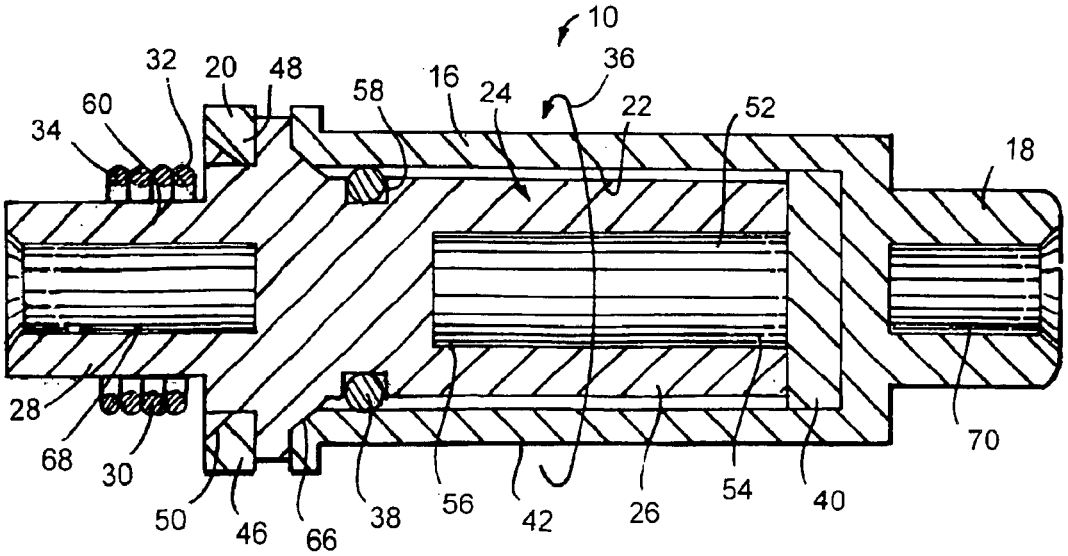
FIG. 2 is an enlarged sectional view of the damper apparatus shown in FIG. 1.

FIG. 2 is a sectional view of the damper apparatus 10 shown in FIG. 1. As shown in FIG. 2, the housing 16 has a first and a second end 18 and 20 respectively, the housing 16 defining a bore 22 which extends between the ends 18 and 20 of the housing 16. The damper 10 further includes a rotor generally designated 24. The rotor 24 includes a first and a second portion 26 and 28 respectively. The first portion 26 of the rotor 24 is rotatably disposed within the bore 22 of the housing 16. A biasing device 30 has a first and a second termination 32 and 34. The biasing device 30 extends between the second portion 28 of the rotor 24 and the housing 16 for rotationally biasing the housing 16 relative to the rotor 24 as indicated by the arrow 36. A seal 38 is disposed between the first and second portions 26 and 28 of the rotor 24. The seal 38 cooperates with the bore 22 for sealing the bore 22 relative to the second portion 28 of the rotor 24 such that in use of the apparatus, damping fluid 40 sealed within the bore 22 by the seal 38 dampens rotational movement 36 of the rotor 24 relative to the bore 22 when the rotor 24 is rotationally biased. The arrangement is such that movement 36 between the first and second elements 12 and 14 is dampened.

In a more specific embodiment of the present invention, the housing 16 is of cylindrical configuration.

Figure 3:
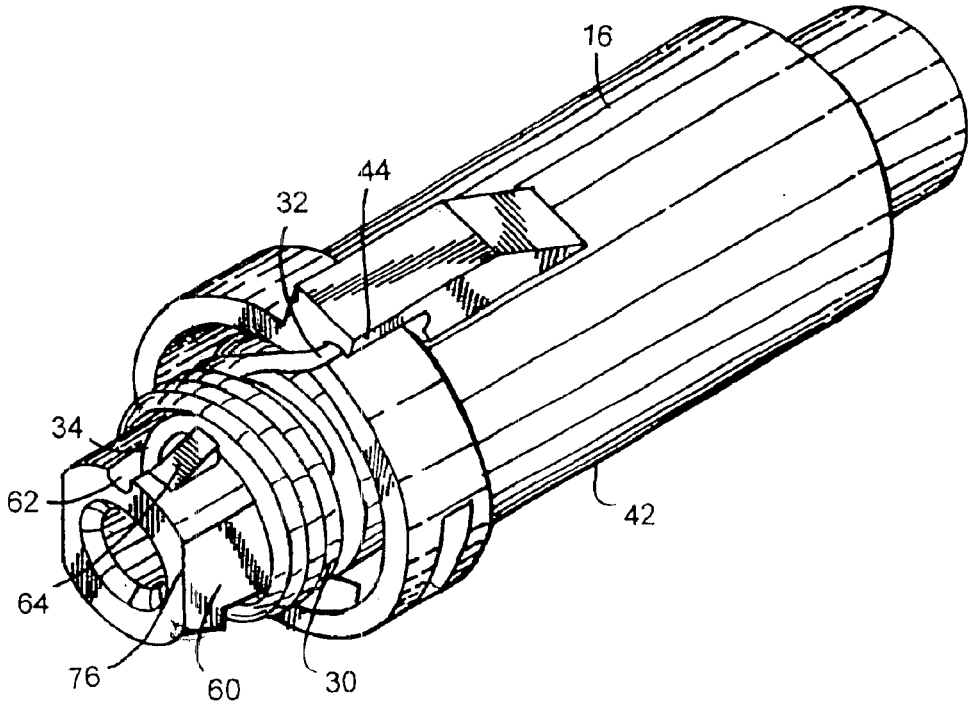
FIG. 3 is an enlarged perspective view of the damper apparatus shown in FIG. 1.

FIG. 3 is a perspective view of the damper apparatus 10 shown in FIG. 1. As shown in FIG. 3, the housing 16 has an outer surface 42 which defines a slot 44 for anchoring therein the first termination 32 of the biasing device 30.

Furthermore, as shown in FIG. 2, the housing 16 has an annular flange 46 which is disposed adjacent to the second end 20 of the housing 16, the flange 46 defining an inwardly projecting lip 48 for locking the first portion 26 of the rotor 24 within the bore 22 when the first portion 26 of the rotor 24 is urged into the bore 22.

More specifically, the flange 46 defines an internal ramp 50 for guiding the first portion 26 of the rotor 24 into the bore 22 preceding locking of the first portion 26 of the rotor 24 within the bore 22.

The first portion 26 of the rotor 24 is of cylindrical configuration for rotation thereof relative to the bore 22.

Additionally, the first portion 26 of the rotor 24 defines a cavity 52 having a first and a second extremity 54 and 56 respectively, the first extremity 54 of the cavity 52 being in fluid communication with the bore 22.

Moreover, the first portion 26 of the rotor 24 defines an annular groove 58 for the reception therein of the seal 38.

The second portion 28 of the rotor 24 includes a support 60 that is of cylindrical configuration. The support 60 is disposed coaxially relative to the first portion 26 of the rotor 24.

Also, the support 60 extends through the biasing device 30 for supporting the biasing device 30.

Additionally, as shown in FIG. 3, the support 60 defines an axial slot 62 for anchoring the second termination 34 of the biasing device 30.

Also, the support 60 defines a ramp projection 64 for guiding the biasing device 30 onto the support 60 and for locking the biasing device 30 onto the support 60.

As shown in FIG. 2, the second portion 28 of the rotor 24 defines a conical surface 66 which cooperates with the ramp 50 for guiding the first portion 26 of the rotor 24 into the bore 22.

Moreover, the second portion 28 of the rotor 24 defines a pivotal hole 68.

Furthermore, the housing 16 defines a further pivotal hole 70 which is disposed coaxially and spaced relative to the pivotal hole 68.

Additionally, the biasing device 30 is a torsion spring.

Figure 4:
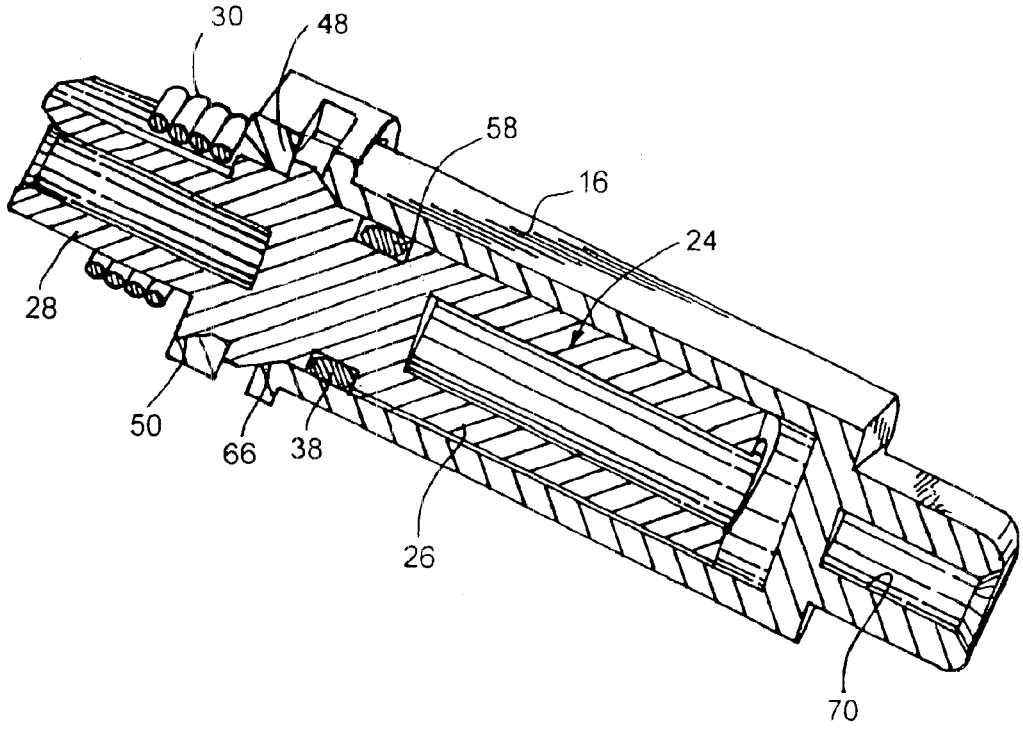
FIG. 4 is a similar view to that shown in FIG. 2 but shown in perspective.

FIG. 4 is a similar view to that shown in FIG. 2 but shown in perspective. As shown in FIG. 4, the rotor 24 is anchored within the housing 16 but is free to rotate therein subject to the spring 30.

More specifically, as shown in FIG. 2, the seal 38 is an O-ring seal.

In operation of the apparatus 10 according to the present invention, the O-ring seal 38 is slipped over the first portion 26 of the rotor 24 and the bore 22 is filled with damping fluid 40. The rotor 24 is then inserted into the bore 22 until the inwardly projecting lip 48 locks the rotor 24 rotatably within the housing 16. The spring 30 is then urged over the ramp projection 64 with the first termination 32 of the spring 30 anchored within the slot 44 as shown in FIG. 3.

Figure 5:
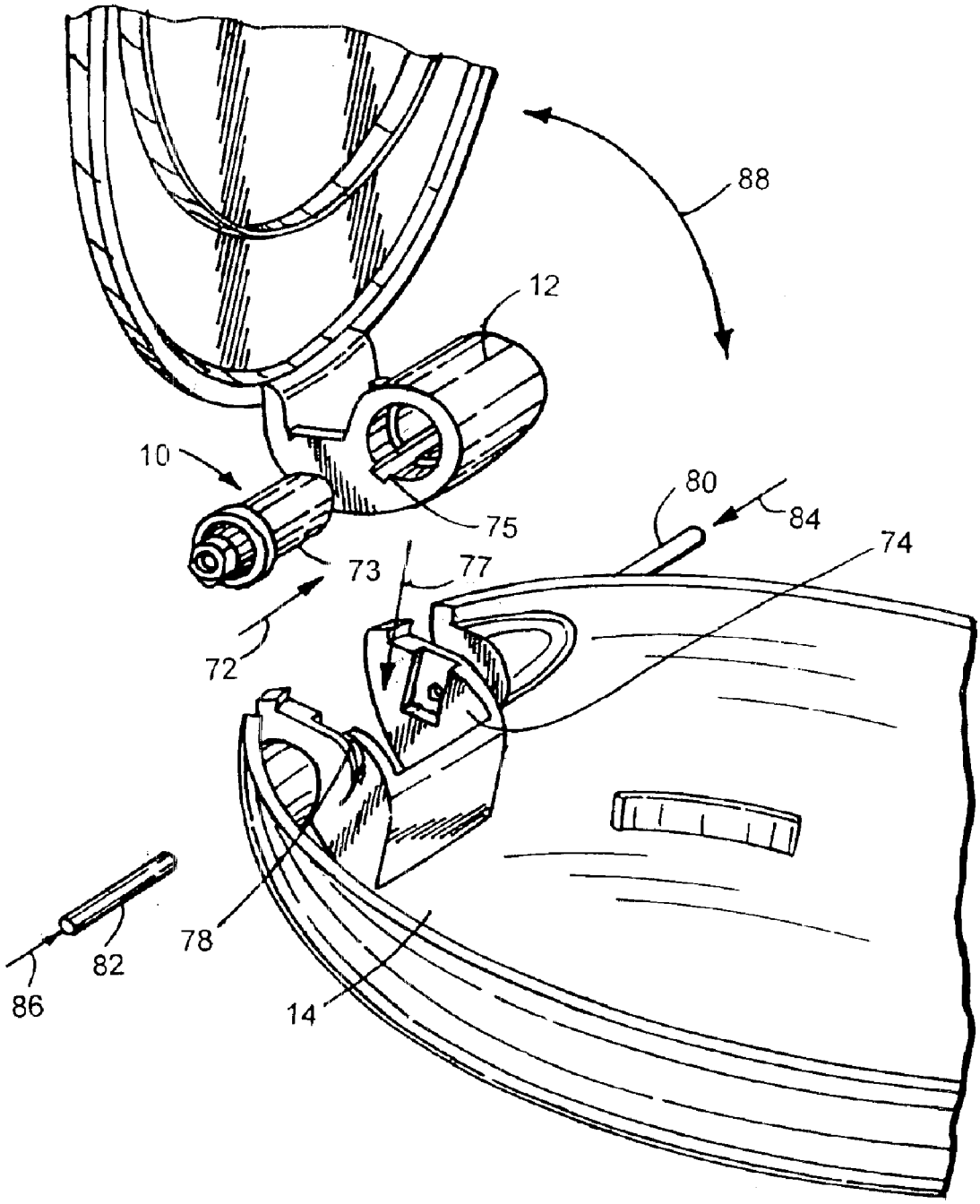
FIG. 5 is an exploded view of the damper apparatus and a lid and base shown in FIG. 1.

FIG. 5 is an exploded view of the damper apparatus 10 and the lid 12 and base 14. As shown in FIG. 5, the damper apparatus or assembly 10 is loaded axially into the lid or first element 12 as indicated by arrow 72. The housing 16 of the damper apparatus 10 includes an axial ridge 73 which cooperates with a corresponding axial groove 75 defined by the lid 12. The first element or lid 12 with the damper assembly 10 in place is then slid as indicated by the arrow 77 into a recess 74 defined by the base or second element 14. As shown in FIG. 3, the support 60 has a flat portion 76 which cooperates with a corresponding flat molding 78 of the recess 74. Pins 80 and 82 are then inserted axially as indicated by the arrows 84 and 86 respectively, so that pivoting of the lid 12 relative to the base 14 as indicated by the arrow 88 is permitted.

However, as the lid 12 is closed, as indicated by the arrow 88, such closing generates a pivotal moment as the spring 30 is tensioned. When the lid 12 is released, the spring 30 urges the lid 12 open but such rotational movement of the spring 30 and attached housing 16 is dampened by the fluid media 40 within the bore 22.

Figure 6:
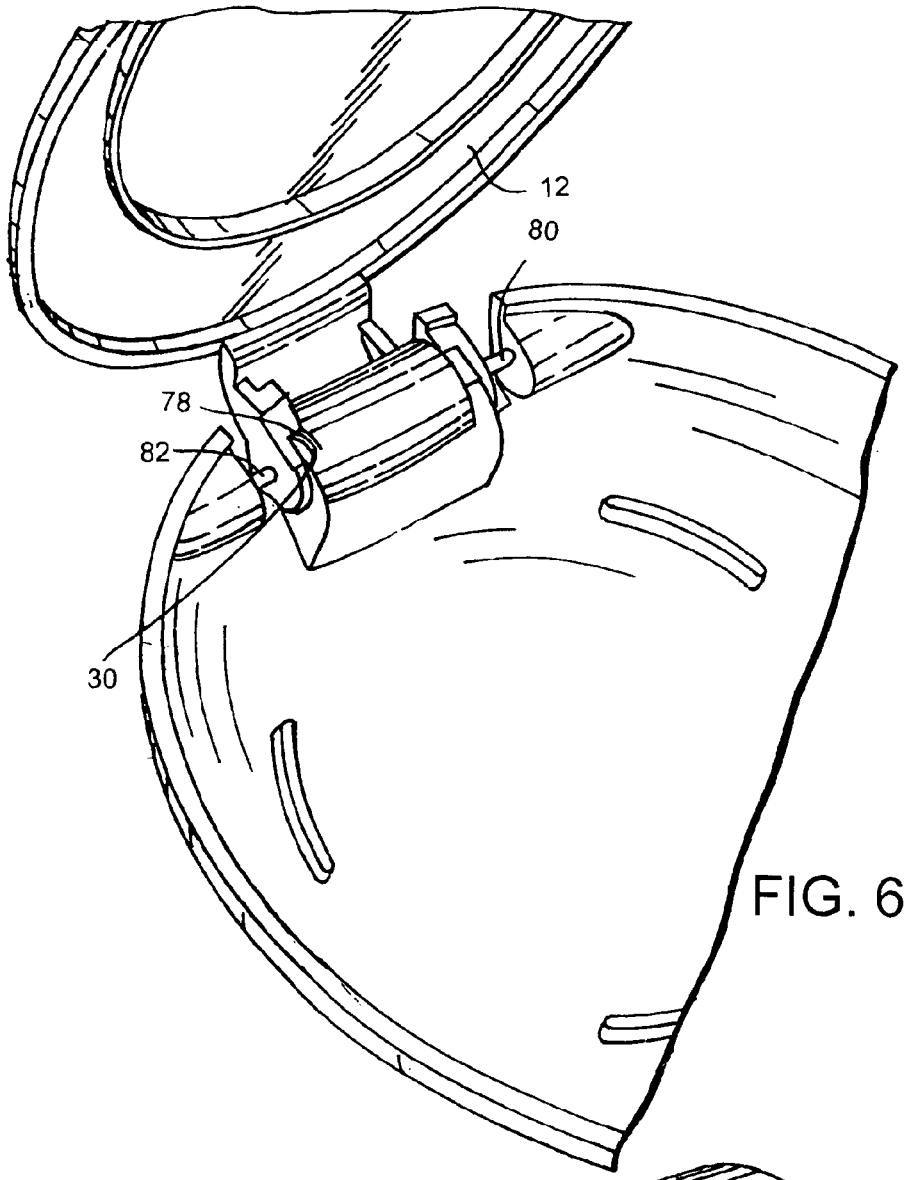
FIG. 6 is a fragmentary perspective view of the assembled components shown in FIG. 5.

FIG. 6 is a fragmentary perspective view that is similar to the view shown in FIG. 5 but viewed from a slightly different angle to show the interrelationship between the various components when assembled. As shown in FIG. 6, the pins 80 and 82 are disposed within the respective pivotal holes 70 and 68 defined by the housing 16 and rotor 24 respectively.

Figure 7:
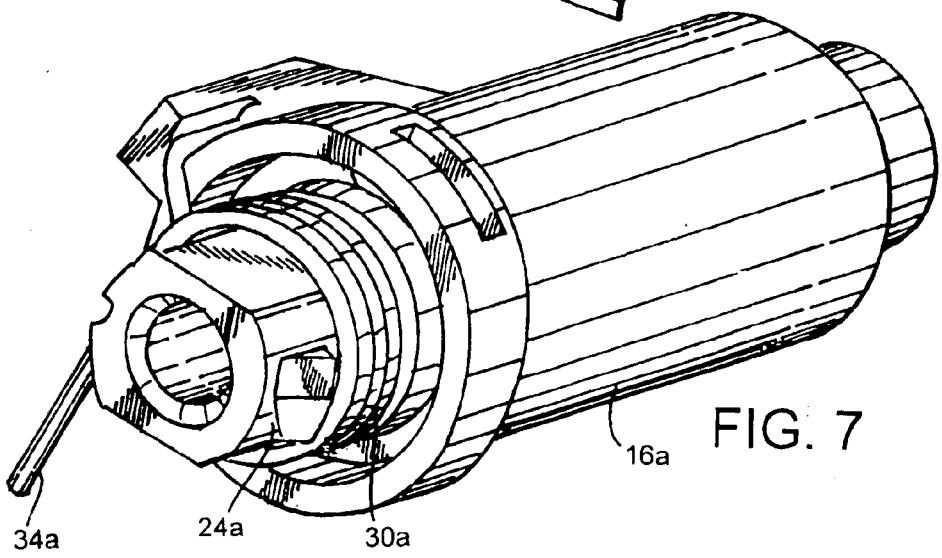
FIG. 7 is a perspective view of a further embodiment of the present invention.

FIG. 7 is a perspective view of a further embodiment of the present invention. As shown in FIG. 7, the second termination 34*a* of a spring 30*a* is adjustably secured to a rotor 24*a* for adjusting biasing of a housing 16*a* relative to the rotor 24*a*.

The present invention provides a unique arrangement for disposing a spring integrally with a housing and rotor while locating the spring externally relative to the rotor and housing thus increasing the rotational force provided by the spring and permitting adjustment of the spring to vary the rotational force provided by the spring.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A damper apparatus for damping movement between a first and a second element, said apparatus comprising:

an elongate housing secured to the first element, said housing having a first and a second end, said housing defining a bore which extends between said ends of said housing, and said housing having an outer surface that defines a slot;

a rotor secured to the second element, said rotor including a first and a second portion, said first portion of said rotor being rotatably disposed within said bore of said housing, and said second portion including a support that extends beyond said second end of said housing so that said support is externally located relative to said bore;

a biasing device having a first and a second termination, said biasing device extending between said second portion of said rotor and said housing for rotationally biasing said rotor relative to said housing, said biasing device being disposed on said support of said rotor such that said biasing device is externally located relative to said bore, and such that said first termination of said biasing device is anchored within said slot of said outer surface of said housing; and a seal disposed between said first and second portions of said rotor, said seal cooperating with said bore for sealing said bore relative to said second portion of said rotor such that in use of said apparatus, damping fluid sealed within said bore by said seal dampens rotational movement of said rotor relative to said bore when said rotor is rotationally biased so that movement between the first and second elements is dampened.

2. A damper apparatus as set forth in claim 1 wherein, said housing is of cylindrical configuration.

3. A damper apparatus as set forth in claim 1 wherein, said housing has an annular flange which is disposed adjacent to said second end of said housing, said flange defining an inwardly projecting lip for locking said first portion of said rotor within said bore when said first portion of said rotor is urged into said bore.

4. A damper apparatus for damping movement between a first and a second element, said apparatus comprising:

an elongate housing secured to the first element, said housing having a first and a second end, said housing defining a bore which extends between said ends of said housing;

a rotor secured to the second element, said rotor including a first and a second portion, said first portion of said rotor being rotatably disposed within said bore of said housing, and said second portion including a support that extends beyond said second end of said housing so that said support is externally located relative to said bore;

a biasing device having a first and a second termination, said biasing device extending between said second portion of said rotor and said housing for rotationally biasing said rotor relative to said housing, said biasing device being disposed on said support of said rotor such that said biasing device is externally located relative to said bore; and a seal disposed between said first and second portions of said rotor, said seal cooperating with said bore for sealing said bore relative to said second portion of said rotor such that in use of said apparatus, damping fluid sealed within said bore by said seal dampens rotational movement of said rotor relative to said bore when said rotor is rotationally biased so that movement between the first and second elements is dampened;

wherein, said housing has an annular flange which is disposed adjacent to said second end of said housing, said flange defining an inwardly projecting lip for locking said first portion of said rotor within said bore when said first portion of said rotor is urged into said bore; and wherein, said flange defines an internal ramp for guiding said first portion of said rotor into said bore preceding locking of said first portion of said rotor within said bore.

5. A damper apparatus as set forth in claim 1 wherein, said first portion of said rotor is of cylindrical configuration for rotation thereof relative to said bore.

6. A damper apparatus as set forth in claim 1 wherein, said first portion of said rotor defines a cavity having a first and a second extremity, said first extremity of said cavity being in fluid communication with said bore.

7. A damper apparatus as set forth in claim 1 wherein, said first portion of said rotor defines an annular groove for the reception therein of said seal.

8. A damper apparatus as set forth in claim 1 wherein, said support of said second portion of said rotor is of cylindrical configuration, said support being disposed coaxially relative to said first portion of said rotor.

9. A damper apparatus as set forth in claim 8 wherein, said support extends through said biasing device for supporting said biasing device.

10. A damper apparatus as set forth in claim 9 wherein, said support defines an axial slot for anchoring said second termination of said biasing device.

11. A damper apparatus as set forth in claim 9 wherein, said support defines a ramp projection for guiding said biasing device onto said support and for locking said biasing device onto said support.

12. A damper apparatus as set forth in claim 4 wherein, said second portion of said rotor defines a conical surface which cooperates with said ramp for guiding said first portion of said rotor into said bore.

13. A damper apparatus as set forth in claim 1 wherein, said second portion of said rotor defines a pivotal hole.

14. A damper apparatus for damping movement between a first and a second element, said apparatus comprising:

an elongate housing secured to the first element, said housing having a first and a second end, said housing defining a bore which extends between said ends of said housing;

a rotor secured to the second element, said rotor including a first and a second portion, of said rotor being rotatably disposed within said bore of said housing, and said second portion including a support that extends beyond said second end of said housing so that said support is externally located relative to said bore;

a biasing device having a first and a second termination, said biasing device extending between said second portion of said rotor and said housing for rotationally biasing said rotor relative to said housing, said biasing device being disposed on said support of said rotor such that said biasing device is externally located relative to said bore; and a seal disposed between said first and second portions of said rotor, said seal cooperating with said bore for sealing said bore relative to said second portion of said rotor such that in use of said apparatus, damping fluid sealed within said dampens rotational movement of said rotor relative to said bore when said rotor is rotationally biased so that movement between the first and second elements is dampened;

wherein, said second portion of said rotor defines a pivotal hole; and wherein, said housing defines a further pivotal hole which is disposed coaxially and spaced relative to said pivotal hole.

15. A damper apparatus as set forth in claim 1 wherein, said biasing device is a torsion spring.

16. A damper apparatus as set forth in claim 15 wherein, said second termination of said spring is adjustably secured to said rotor for adjusting biasing of said housing relative to said rotor.

17. A damper apparatus as set forth in claim 1 wherein, said seal is an O-ring seal.

18. A damper apparatus for damping movement between a first and a second element, said apparatus comprising:

an elongate housing secured to the first element, said housing having a first and a second end, said housing defining a bore which extends between said ends of said housing, said housing including an axial ridge on an outer surface thereof, said axial ridge being adapted to cooperate with a corresponding axial groove of the first element when said housing is secured to the first element;

a rotor connected to the second element, said rotor including a first and a second portion, said first portion of said rotor being rotatably disposed within said bore of said housing, and said second portion including a support that extends beyond said second end of said housing so that said support is externally located relative to said bore, said support including a flat portion that is adapted to cooperate with a corresponding flat of a recess in the second element when the rotor is connected to the second element;

a biasing device having a first and a second termination, said biasing device extending between said second portion of said rotor and said housing for rotationally biasing said rotor relative to said housing, said biasing device being disposed on said support of said rotor such that said biasing device is externally located relative to said bore; and a seal disposed between said first and second portions of said rotor, said seal cooperating with said bore for sealing said bore relative to said second portion of said rotor such that in use of said apparatus, damping fluid sealed within said bore by said seal dampens rotational movement of said rotor relative to said bore when said rotor is rotationally biased so that movement between the first and second elements is dampened, and such that said second termination of said biasing device being adjustably secured to said rotor for adjusting biasing of said housing relative to said rotor.

19. A damper apparatus for damping movement between a first and a second element, said apparatus comprising:

an elongate housing secured to the first element, said housing having a first and a second end, said housing defining a bore which extends between said ends of said housing;

a rotor secured to the second element, said rotor including:

a first and a second portion, said first portion of said rotor being rotatably disposed within said bore of said housing; and a biasing device having a first and a second termination, said biasing device extending between said second portion of said rotor and said housing for rotationally biasing said rotor relative to said housing;

a seal disposed between said first and second portions of said rotor, said seal cooperating with said bore for sealing said bore relative to said second portion of said rotor such that in use of said apparatus, damping fluid sealed within said bore by said seal dampens rotational movement of said rotor relative to said bore when said rotor is rotationally biased so that movement between the first and second elements is dampened;

said housing being of generally cylindrical configuration having an outer surface which defines a slot for anchoring therein said first termination of said biasing device;

said housing having an annular flange which is disposed adjacent to said second end of said housing, said flange defining an inwardly projecting lip for locking said first portion of said rotor within said bore when said first portion of said rotor is urged into said bore;

said flange defining an internal ramp for guiding said first portion of said rotor into said bore preceding locking of said first portion of said rotor within said bore;

said first portion of said rotor being of cylindrical configuration for rotation thereof within said bore;

said second portion of said rotor including:

a support which is of cylindrical configuration, said support being disposed coaxially relative to said first portion of said rotor, said support being located external to said bore in said housing;

said support extends through said biasing device for supporting said biasing device, such that said biasing device is externally located relative to said bore;

said support defining an axial slot for anchoring said second termination of said biasing device; and said second termination of said spring being adjustably secured to said rotor for adjusting biasing of said housing relative to said rotor.

* * * * *